United States Patent [19]

Löhner et al.

[11] 4,333,437

[45] Jun. 8, 1982

[54] TIMING CONTROL APPARATUS FOR FUEL INJECTION PUMP

[75] Inventors: Ingolf Löhner, Brunswick; Konrad Barnert; Günter Stein, both of Wolfsburg, all of Fed. Rep. of Germany

[73] Assignee: Volkswagenwerk Aktiengesellschaft, Wolfsburg, Fed. Rep. of Germany

[21] Appl. No.: 192,617

[22] Filed: Sep. 30, 1980

Related U.S. Application Data

[62] Division of Ser. No. 894,944, Apr. 10, 1978, abandoned.

[30] Foreign Application Priority Data

Apr. 13, 1977 [DE] Fed. Rep. of Germany ..... 2716307

[51] Int. Cl.[3] ..... F02M 59/32

[52] U.S. Cl. ..... 123/502; 123/179 L

[58] Field of Search ..... 123/502, 501, 179 L, 123/366, 367, 368, 339, 179 G

[56] References Cited

U.S. PATENT DOCUMENTS 2,906,253 9/1959 Nallinger ..... 123/179 G
2,910,975 11/1959 Evans ..... 123/502
4,122,813 10/1978 Barnert ..... 123/502

FOREIGN PATENT DOCUMENTS 993888 6/1965 United Kingdom ..... 123/502

*Primary Examiner*—Charles J. Myhre
*Assistant Examiner*—Carl Stuart Miller
*Attorney, Agent, or Firm*—Brumbaugh, Graves, Donohue & Raymond

[57] ABSTRACT

An apparatus for controlling fuel injection timing in a diesel engine includes a piston activated by supplied pressure proportional to engine speed to advance the injection timing of the fuel injection pump in accordance with engine operating speed. In accordance with the invention, the injection timing control apparatus is provided with an adjusting mechanism which responds to a supplied indication of engine temperature for advancing the injection timing when the engine is cold and retarding the injection timing when the engine is at normal operating temperature. In a preferred embodiment, the indication of engine temperature is fluid pressure which is controlled by a valve and acts on an adjusting member to increase the tension on the piston return spring when the engine is at operating temperature.

2 Claims, 4 Drawing Figures

TIMING CONTROL APPARATUS FOR FUEL INJECTION PUMP

This is a division, of application Ser. No. 894,944 filed Apr. 10, 1978 and now abandoned.

BACKGROUND OF THE INVENTION

This invention relates to apparatus for controlling the injection timing of a fuel injection pump in a diesel engine. Such mechanisms are well known wherein the engine is provided with a pump which supplies fluid pressure proportional to engine speed. The fluid pressure acts on a piston in a cylinder in opposition to a return spring and moves the piston to advance injection timing at higher engine speeds.

Conventional injection timing devices provide proper control of injection timing when the engine is at its normal operating temperature, and provide advancement of the timing with increased engine speed. Since the fluid pressure supplied to the device is proportional to engine speed, and the force of the return spring on the piston is proportional to displacement, a linear variation of injection timing is obtained over the full engine speed operating range with the result of improved emission control.

During cold starting and warming up of the engine, it is desirable to have a more advanced timing of injection, particularly at low speed, to achieve a favorable combustion condition and a reduction of the "blue smoke period".

Published German Patent Application No. 1,143,675 discloses a device which includes inner and outer injection timing adjustment pistons, both of which are acted upon by the speed proportional fluid pressure in opposition to respective inner and outer return springs. The return spring of the inner piston is weaker than that of the outer piston so that the inner piston becomes fully displaced at a relatively low supplied pressure. The outer piston has a stronger spring and is arranged for displacement in the direction opposite to that of the inner piston. The inner piston is connected to the injection timing device of the fuel injection pump. Prior to initial starting of the engine, under the influence of the inner and outer return springs, the pistons cause the fuel pump to have an advanced injection timing condition. After the engine has been started and a relatively low speed proportional fluid pressure is supplied to the pump, the inner piston is rapidly displaced against its weaker spring to a retarded injection timing condition. Thereafter, the inner and outer pistons move together in a direction opposite to the original movement of the inner piston under the influence of the supplied fluid pressure to advance injection timing in proportion to supplied pressure and consequently engine speed.

This prior art injection control device provides an injection timing advance for initial engine starting, but immediately upon engine starting, upon displacement of the inner piston, the injection timing is retarded into the normal injection timing condition, independent of the operating temperature of the engine. Therefore, while there is provided advanced injection timing during engine starting, there is no advanced injection timing during the warm-up period. Further, this prior mechanism with dual pistons is relatively expensive to construct.

Recognizing that different injection advancement conditions are required for favorable engine operation during the warm-up period and normal temperature engine operation, and that a timing condition which is favorable for operating temperature is unfavorable for a cold engine, the adjustment of the injection timing merely in accordance with the amount of supplied speed proportional pressure, as in this prior device, does not provide sufficient control of injection timing for smooth and pollution-free engine operation particularly at low engine speeds.

Another prior adjustment device for fuel injection timing is disclosed in German Published Patent Application No. 1,094,527. The device therein disclosed includes a valve in the conduit supplying speed proportional pressure to the timing adjustment cylinder. The valve is designed to open only upon the attainment of a predetermined minimum pressure. Accordingly, the operation of the fuel injection timing adjustment device is also controlled only in accordance with speed proportional pressure, and not in accordance with engine temperature, as is required for optimum engine operation.

It is therefore an object of the invention to provide an adjustment device for a fuel injection pump in a diesel engine which is relatively inexpensive to construct, and which provides injection timing which is adjusted for the temperature condition of the internal combustion engine as well as operating engine speed.

SUMMARY OF THE INVENTION

In accordance with the invention, there is provided apparatus for regulating the injection timing of a fuel injection pump in a diesel engine in accordance with engine temperature and speed. The apparatus includes means for supplying a first fluid pressure proportional to engine speed. A timing piston is moveably mounted in a cylinder, and acted on by the first fluid pressure. An actuating member connects the piston to the fuel injection pump so that the injection timing of the pump is advanced upon movement of the piston under the influence of the fluid pressure. There is provided a spring urging the piston against the pressure, and spring tension adjusting means responsive to a supplied indication of engine temperature, for acting on the spring and increasing the force of the spring against the piston.

In one embodiment, the supplied indication of engine temperature comprises a second controlled source of fluid pressure. The tension adjusting means then comprises a moveable control element engaging one end of the spring and acted on by the second controlled fluid pressure to move in the direction of the spring and thereby increase the spring force against the piston. The second controlled source of fluid pressure may be regulated by a valve controlled according to engine temperature, or may include a throttle which restricts flow from a fluid pressure source and thereby controls the rate at which the pressure on the moveable element increases after the start of engine operation. The moveable control element may be provided with a stop which engages the piston and limits the movement of the piston under the influence of the first fluid pressure. A third controlled source of fluid pressure may be provided for supplying pressure to act on the moveable control element in a direction opposite to the action of the second controlled pressure. Alternately, a control spring may be provided for acting on the moveable control element in the direction opposite to the action of fluid pressure to change the response characteristics of the moveable control element.

In one arrangement, the controlled source of fluid pressure may also be used for regulating the idle throttle setting of the engine. In this case, a second piston is provided which is connected to an idle stop and has a spring urging the piston and stop to an advanced idle position. When the second controlled fluid pressure is provided to the second piston, it will move in opposition to the spring and thereby move the idle stop out of the advanced idle position.

In another embodiment of the invention, the supplied indication of engine temperature comprises supplied heat and the tension adjusting means comprises a mechanical thermostat engaging one end of the spring and operative in response to the heat to move in the direction of the spring and increase spring force against the timing piston. The supplied heat may be provided from engine cooling fluid or from an electric heating element.

In a further variation of the invention, there may be provided a spring acting on the timing piston in the same direction as the first fluid pressure and having a limited spring range so that the spring is ineffective when the piston is displaced by a selected amount under the influence of the first fluid pressure.

The injection timing control device according to the invention provides timing control not only as a function of engine speed but also according to other engine operating parameters, in particular the operating temperature of the engine. The device first reduces initial tension in the timing piston return spring when the engine is cold, thereby to lengthen the available adjustment path of the injection timing piston under the influence of the speed proportional pressure in comparison with the condition when the engine is warmed up. The lower return spring force and increased adjustment path of the piston results in the achievement of more advanced injection timing for comparable engine speeds, and thus provides a more favorable condition for combustion in the engine during the warming-up period.

In accordance with the various embodiments of the invention, a wide range of injection timing versus engine operating condition characteristics can be achieved. In particular, by the use of additional springs, or by the provision of a third controlled fluid pressure, non-linear variations of injection timing with engine speed or other operating parameters can be achieved.

For a better understanding of the present invention, together with other and further objects, reference is made to the following description, taken in conjunction with the accompanying drawings, and its scope will be pointed out in the appended claims.

DESCRIPTION OF THE INVENTION

Figure 1:
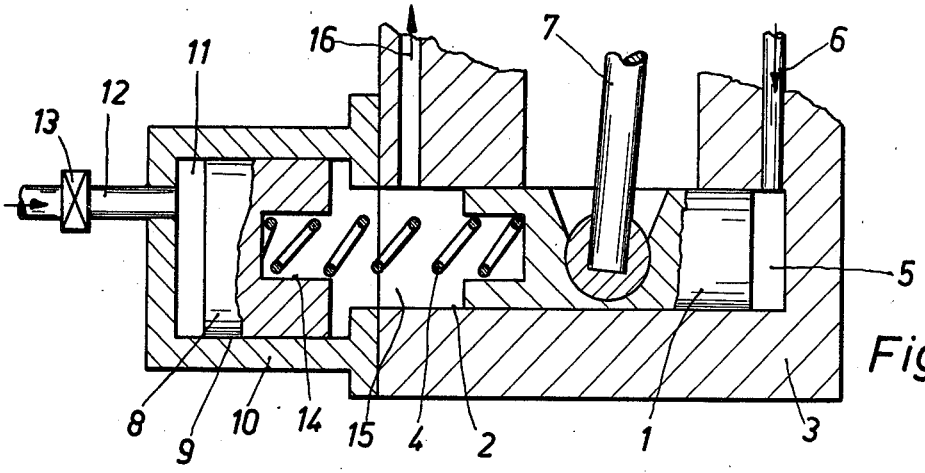
FIG. 1 is a cross-sectional view of a fuel injection timing adjustment device in accordance with the present invention.

The cross-sectional drawing of FIG. 1 illustrates an injection timing adjustment apparatus for a diesel engine in accordance with the present invention. The apparatus includes a timing piston 1 which is moveably mounted in a cylindrical bore 2 within housing 3. Piston 1 is urged to the right in the drawing under the influence of a return spring 4. A working chamber 5 is formed on the opposite side of the piston and is provided with fluid pressure proportional to engine speed through conduit 6.

In accordance with the usual operation of such injection timing devices, the fluid pressure supplied over conduit 6 is provided from a fuel pump or other engine driven pump, and is proportional to the operating speed of the engine.

The piston 1 is connected to an actuating member 7 which engages the control element of the fuel injection pump in a known manner, and provides an adjustment of the injection timing of the pump. The pump is arranged so that displacement of piston 1 to the left in the drawing advances the start of fuel injection with respect to engine rotation, and displacement of piston 1 to the right in the drawing retards the start of fuel injection. The FIG. 1 embodiment is provided with a moveable control element, comprising piston 8, which is mounted in a cylindrical bore 9 in control housing 10. Control housing 10 is mounted at one end of housing 3 so that control piston 8 moves in cylindrical bore 9 in a direction towards and away from timing piston 1. Return spring 4 of timing piston 1 is mounted in a recess 14 on the end of control piston 8.

Piston 8 and cylinder 9 form a working chamber 11 in control housing 10. A controlled second fluid pressure is supplied to chamber 11 by pressure conduit 12. A valve device 13 or a throttle is provided in conduit 12 to regulate the supply of fluid pressure to working chamber 11 in accordance with operating characteristics of the engine, particularly engine temperature. Displacement of control piston 8 results in a modification of the tension on spring 4 and thereby determines the magnitude and range of the adjustment path of timing piston 1 under the influence of pressure supplied over conduit 6. Conduit 16 is provided as a return path for fluid which enters the intermediate space 15 between pistons 1 and 8 by flowing around the periphery of the pistons.

The operation of the device of FIG. 1 may be explained with reference to operating conditions of its associated engine. When the engine is not operating at all, no pressure is provided in conduits 6 or 12 and injection timing piston 1 moves fully to the right under the influence of spring 4, and control piston 8 moves fully to the left. In this state, spring 4 is in an almost fully relaxed condition. Upon initial starting of the engine, a pump provides a speed proportional pressure over conduit 6 to working chamber 5. Depending on the position of valve 13, fluid pressure is also provided to chamber 11 through conduit 12. The pressure provided to chamber 5 acts to move piston 1 to the left in the direction of advanced injection timing. The pressure supplied to chamber 11 displaces control piston 8 to the right in a direction which increases the tension on spring 4 and tends to displace timing piston 1 in the direction of retarded injection timing.

In accordance with the invention, the pressure provided to working chamber 11 is a function of the actual or simulated operating temperature of the engine. When the engine is cold, valve 13 is closed, no pressure is provided to working chamber 11, and control piston 8 remains in its left extreme position thereby providing only a small stressing of spring 4 against piston 1 in opposition to the pressure in working chamber 5. Under this condition, the piston 1 will tend to undergo relatively large movement in the direction of advanced injection timing under the influence of the pressure supplied to chamber 5.

When the engine reaches operating temperature, valve 13 is gradually or abruptly opened so that pressure is permitted to enter working chamber 11 through conduit 12. This pressure moves piston element 8 to the right and thereby increases the tension on return spring 4. The increased tension on spring 4 causes a displacement of piston 1 to the right, in the direction of retarded injection timing, if the same amount of pressure is supplied to working chamber 5. This movement compensates for the initial advancement of the injection timing during cold start and warming up when valve 13 is closed. After the complete opening of valve 13, piston 1 continues to operate to adjust injection timing under the influence of the speed proportional pressure supplied to chamber 5 and the return spring 4.

In the event the engine is starting in a warmed up condition, valve 13 can be immediately opened and accordingly control piston 8 will be initially moved to its position to the right of cylindrical bore 9 and injection timing piston 8 will operate under the high tension condition of return spring 4 immediately upon starting of the engine.

Valve 13 in conduit 12 may be designed as a thermostatically controlled pressure valve which responds to engine temperature, but may alternately be an electromagnetically actuated control valve, which is operated by a thermostat switch connected to the engine.

An alternate to providing a valve device 13, which opens when the engine is warmed up, for example, under the influence of an electrical signal from an engine temperature sensing device, there may be provided a throttle nozzle as a control device 13 which permits only a slow build up of pressure in working chamber 11 after the engine is started. By suitable dimensioning of the nozzle, an adequate time delay corresponding to the warming up period of the engine can be provided for the build up of pressure in chamber 11 and consequent movement of control element 8 to the right to prestress spring 4. In this manner, the stressing of spring 4 to the normal operating condition can be delayed until the engine is approximately warmed up without the use of a temperature responsive valve control arrangement.

Figure 2:
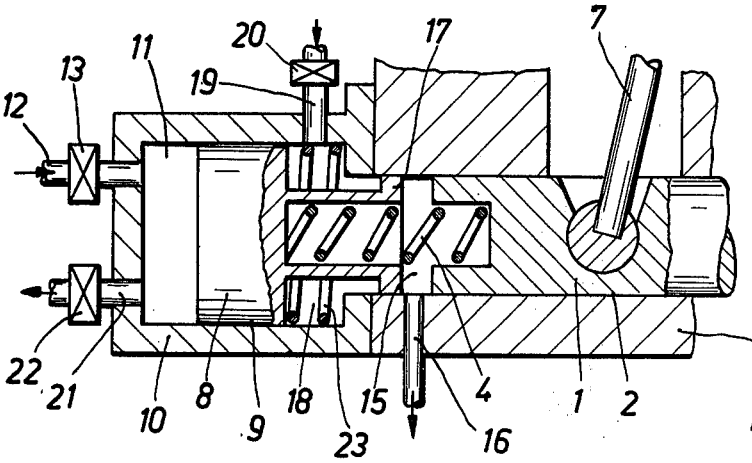
FIG. 2 is a cross-sectional view of a variation of the FIG. 1 device wherein there is provided controlled fluid pressure operating on the adjustment element in both directions of adjustment.

The embodiment illustrated in FIG. 2 is similar to that illustrated in FIG. 1 and corresponding elements of the device are indicated by the same reference numerals. In the FIG. 2 embodiment, control piston 8 is provided with a stop 17 which projects into cylindrical bore 2 of housing 3 and is arranged to limit the displacement of the injection timing piston 1 in the direction of timing advancement. This limit is variable according to the location of control piston 8 and therefore sets different limits of the timing piston movement according to the position of control piston 8.

The FIG. 2 embodiment also is provided with a working chamber 18 on the opposite side of control piston 8 from the original working chamber 11. Chamber 18 is provided with controlled pressurized fluid over conduit 19 on which there is provided valve 20. The original working chamber 11 is provided with a fluid return line 21 in which there is provided a third valve 22 for controlling the return of pressurized fluid.

The control piston 8 of the FIG. 2 device can be provided not only with controlled pressurized fluid for movement toward the right to increase the tension of spring 4 by the control of valve 13, but may also be moved to the left, in the direction of decreased spring tension by providing pressurized fluid to chamber 18 by the use of valve 20 and conduit 19 while at the same time allowing pressure to flow out of chamber 11 through conduit 21 by opening valve 22. This embodiment therefore enables full control of the position of element 8 by the control of valves 13, 20, and 22. Thus, the control element 8 may be moved not only as a function of engine temperature, but also according to engine speed or load. The displacement characteristics of element 8 may be further modified by the provision of an additional return spring 23 urging the control position in a direction opposite to the fluid pressure in chamber 11 or by providing a control spring in chamber 11 acting in opposition to fluid pressure in chamber 18.

Another possible embodiment, which is not illustrated in the drawings, is the use of negative pressure proportional to engine operating characteristics, which may be taken from the engine suction pipe or generated by a vacuum pump. Such negative pressure acting on a suitable diaphragm can be used instead of the control piston 8 for modifying tension on spring 4.

Figure 3:
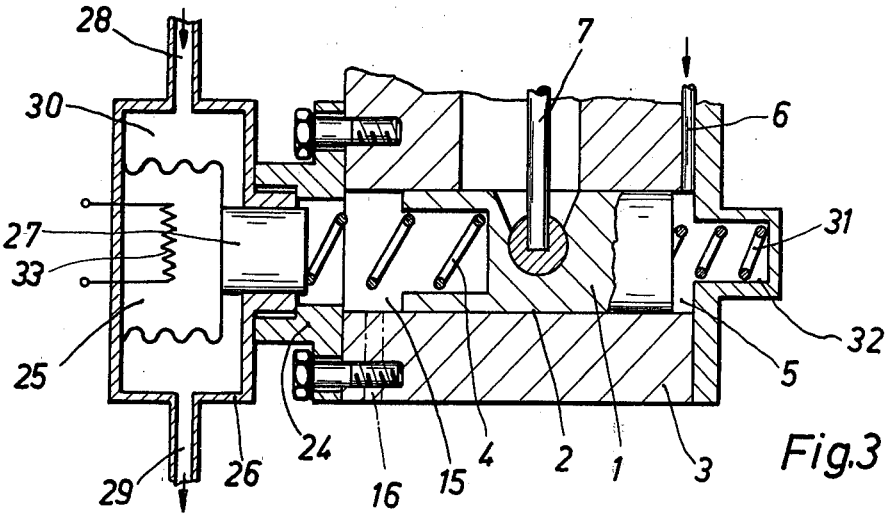
FIG. 3 is a cross-sectional view of an injection timing adjustment device wherein adjustment of spring tension is achieved by a mechanical thermostat.

FIG. 3 illustrates an embodiment of the invention wherein tension in spring 4 is controlled directly by heat rather than by supplied controlled fluid pressure. In the FIG. 3. embodiment, there is provided a mechanical thermostat 25 which is arranged in housing 26 through which there is provided a flow of engine coolant by means of conduits 28 and 29. Housing 26 is mounted to housing 3 by the use of flange 24. Piston 27 extends from mechanical thermostat 25 and according to the temperature of the engine coolant in the interior 30 of thermostat housing 26, piston 27 moves to adjust the tension of spring 4 which acts on injection timing piston 1. When the temperature of the engine coolant is relatively low, piston 27 moves to the left reducing tension on spring 4 and providing more advanced injection timing, in accordance with speed proportional pressure supplied over conduit 6. If the temperature of the engine coolant increases, piston 27 is moved to the right by thermostat 25 and increases the tension on return spring 4, thereby retarding injection timing.

The embodiment illustrated in FIG. 3 includes a spring 31 which is maintained in a recess 32 located at the end of pump housing 3 adjacent the end of cylindrical bore 2. Spring 31 exerts a force on piston 1 when the piston is most advanced to the right, but has a limited range of elasticity so that after a selected amount of movement of piston 1 to the left, spring 31 no longer acts on piston 1. Thus, spring 31 acts to modify the timing adjustment characteristics of piston 1 for low engine speeds corresponding to low fluid pressure in chamber 5. Further modifications of the low speed operation of piston 1 can be provided by the use of several springs having selected spring constants which become successively ineffective on movement of piston 1 to the left. Such springs modify the characteristic curve of the timing adjustment device in the low speed range, and provide a relatively flat low speed curve.

The thermostat 25 illustrated in FIG. 3 may be provided with an electrical heater 33 rather than be connected to the engine cooling system. Upon starting of the engine, current may be supplied to heater 33 and the heater and thermostat can be arranged so that the thermostat reaches its operative temperature at approximately the same time the engine reaches normal operating temperature.

Figure 4:
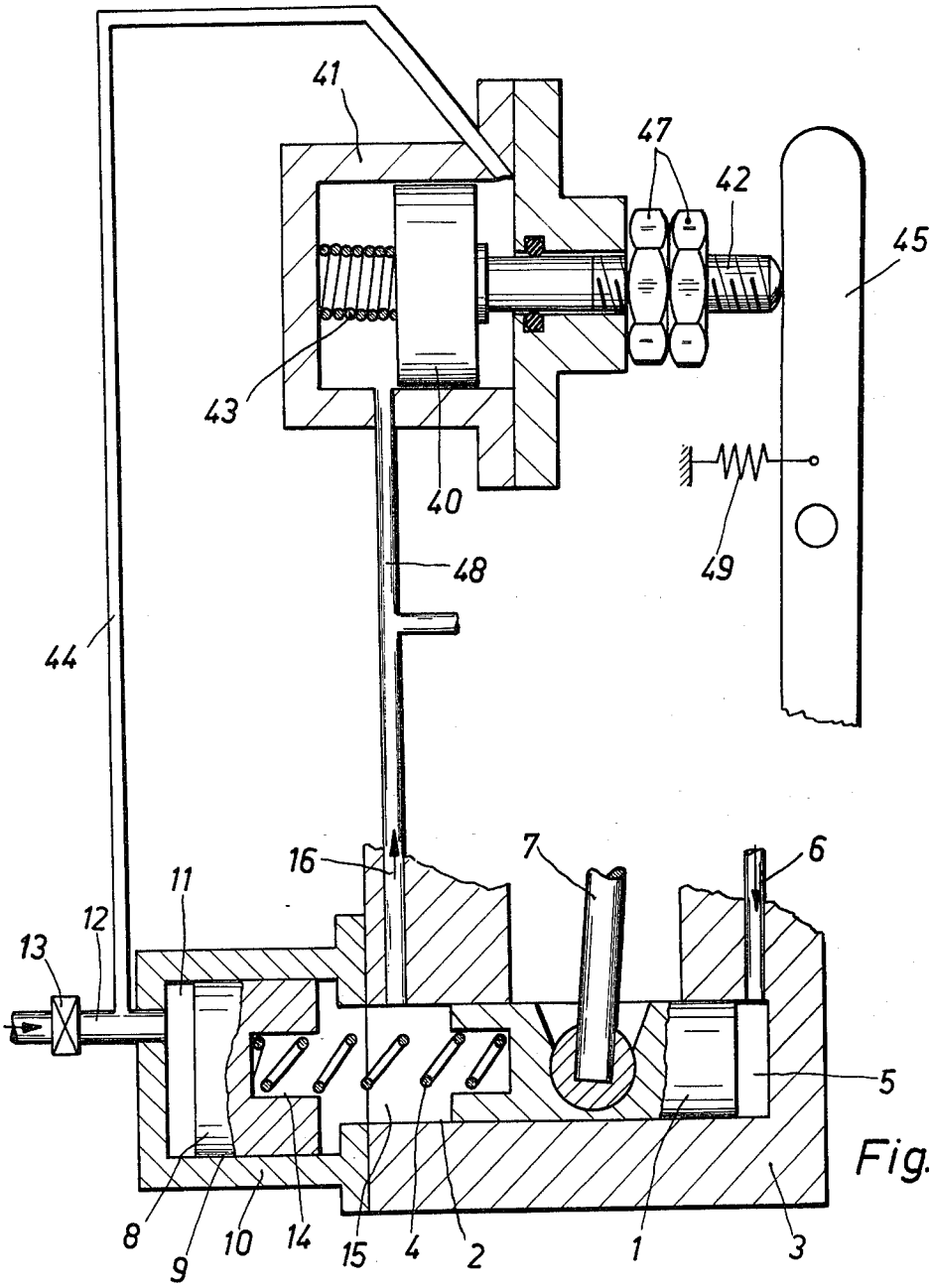
FIG. 4 is a cross-sectional view of an apparatus in accordance with the invention which is additionally arranged to control the idle setting in accordance with engine temperature.

FIG. 4 illustrates portions of a diesel engine wherein the same controlled source of fluid pressure which is used for modifying the characteristics of the injection timing piston 1 are also used to control the idle setting of the engine throttle. The speed adjustment lever 45 of the engine is provided with a return spring 49 and engages a mechanical stop 42. Stop 42 is mounted to piston 40 which slides in a cylindrical chamber in housing 41. Spring 43 is provided bearing on piston 40 to move the piston and stop 42 in a direction of increased idle speed.

During starting and warming up of the engine, valve 13 is closed and control piston 8 of the injection timing mechanism is in its left position. Also, idling stop 42 and piston 40 are in a right extreme position under the action of spring 43. When the engine reaches operating temperature, valve 13 opens and fluid pressure is provided to working chamber 11 in the injection timing device to move control piston 8 in a direction which retards injection timing, and at the same time fluid pressure is also provided through conduit 44 into housing 41 and moves piston 40 to the left against spring 43 thereby retarding idle setting to the position determined by check nuts 47. Conduit 48 is provided for the return of fluid from housing 41. In accordance with the arrangement of FIG. 4, the same controlled fluid pressure may be used for adjustment of both injection timing and throttle idle setting.

By the use of the various embodiments of the invention, the operational characteristics of the injection timing apparatus can be modified in accordance with a supplied indication of engine temperature to have a different characteristic during cold starting and warming up than during normal engine operation. Thus, the injection timing is optimized for all engine operating conditions. It should be noted that the supplied indication, such as fluid pressure or heat, need not be derived from actual engine temperature, but may be supplied by means of a device, such as an electric resistance heater or a fluid nozzle, which provides a time delay in the operation of the device which simulates the engine temperature during the initial starting and warming up period.

While there have been described what are believed to be the preferred embodiments of the invention, those skilled in the art will recognize that other and further modifications may be made thereto without departing from the spirit of the invention, and it is intended to claim all such embodiments as fall within the true scope of the invention.

We claim:

1. Apparatus for regulating the injection timing of a fuel injection pump in a diesel engine in accordance with engine temperature and speed, comprising:

(a) means for supplying a first fluid pressure proportional to engine speed;

(b) means for supplying a second fluid pressure, controlled according to engine temperature, including a source of said pressure and a valve;

(c) a first piston movably mounted in a cylinder and acted upon by said first fluid pressure;

(d) an actuating member connecting said piston to said fuel injection pump for advancing the injection timing of said pump upon movement of said first piston by said first fluid pressure;

(e) a spring means urging said first piston against said first fluid pressure; and (f) a spring tension adjusting means comprising a movable control element engaging one end of said first spring means and acted upon by said second controlled fluid pressure to move in the direction of said first spring means thereby increasing said spring force against said first piston;

said apparatus further comprising a second piston movably mounted in a second cylinder and connected to an idle stop, a second spring means urging said second piston and said idle stop to an advanced idle position, and means for providing said second controlled fluid pressure to said second cylinder to act on said second piston in opposition to said second spring means and thereby to move said idle stop out of said advanced idle position.

2. Apparatus as specified in claim 1 wherein there is provided at least one pressure spring acting on said first piston in the same direction as said first fluid pressure and having a limited spring range, whereby said pressure spring is ineffective when said first piston is displaced a selected amount by said pressure.

* * * * *